US005214863A

United States Patent [19]

Skaja

[11] Patent Number: 5,214,863

[45] Date of Patent: Jun. 1, 1993

[54] FOOTWEAR LACE LOCKING ASSEMBLY

[75] Inventor: Joseph J. Skaja, Lawrence, Kans.

[73] Assignee: Kaepa, Inc., San Antonio, Tex.

[21] Appl. No.: 784,640

[22] Filed: Oct. 28, 1991

Related U.S. Application Data

[63] Continuation of Ser. No. 219,936, Jul. 15, 1988, abandoned, which is a continuation-in-part of Ser. No. 074,953, Jul. 17, 1987, Pat. No. 4,899,466, which is a continuation-in-part of Ser. No. 916,531, Oct. 8, 1986, abandoned.

[51] Int. Cl.[5] ..... A43B 11/00; A43C 05/00

[52] U.S. Cl. ..... 36/501; 24/713.2; 24/713.4; 24/713.6

[58] Field of Search ..... 36/50; 24/140, 141, 24/117, 119

[56] References Cited

U.S. PATENT DOCUMENTS

| | | | |
|---|---|---|---|
| 805,220 | 11/1905 | Morrison | 24/141 |
| 965,930 | 8/1910 | Perkins | 24/140 |
| 1,384,565 | 7/1921 | Martin | 24/141 |
| 1,434,723 | 11/1922 | Triay, Jr. | 24/140 |
| 1,466,075 | 8/1923 | Triay, Jr. | 24/140 |
| 2,239,325 | 4/1941 | Hius | 24/141 |
| 2,795,830 | 6/1957 | Leatherman | 24/141 |
| 4,200,998 | 5/1980 | Adams | 36/50 |
| 4,553,342 | 11/1985 | Derderian et al. | 36/50 |
| 4,670,949 | 6/1987 | Autry | 36/50 |
| 4,698,921 | 10/1987 | Townsend | 36/136 |

*Primary Examiner*—Steven N. Meyers
*Attorney, Agent, or Firm*—Cohn, Powell & Hind

[57] ABSTRACT

This lacing assembly is for use with an article of footwear (10) and includes lower and upper vamp sections (26 and 30) connected by a single continuous lace (36). The lower vamp section (26) includes opposed vamp portions (28) having lace-receiving eyelets (42) including opposed upper end locking eyelets (44). The upper vamp section (30) includes opposed vamp portions (32) having lace receiving eyelets (46) including opposed lower end locking eyelets (48). The locking eyelets (44 and 48) include a locking member (50) having an eyelet opening (54) and a communicating slit (60) which receives the lace (36) in locked relation. The locking eyelets (44 and 48) permit the fit of the lower vamp section (26) to be adjusted selectively and independently of the upper vamp section (30). The lacing assembly also provides lace locking eyelets (150) which can be used at the upper end of the vamp section (26, 30) as a whole or intermediate the ends of said vamp section as a whole so that the lace can be adjusted and maintained in adjustment.

4 Claims, 5 Drawing Sheets

FIG. 7.
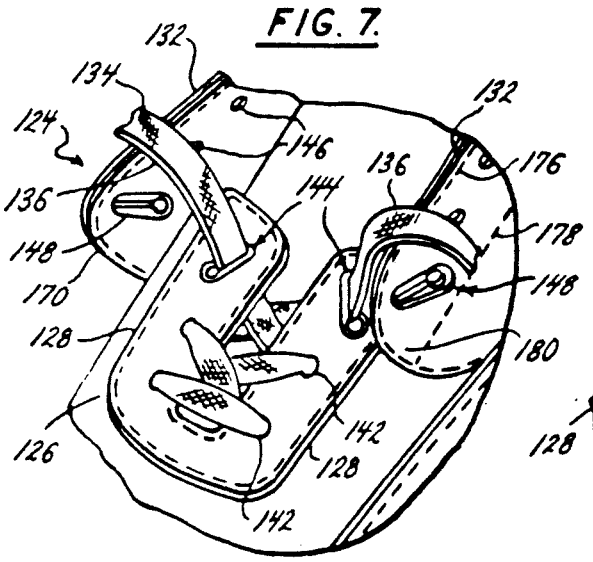
FIG. 8.
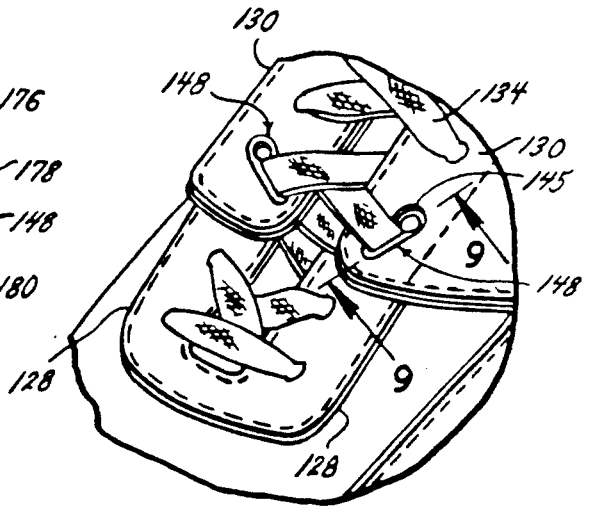
FIG. 10.
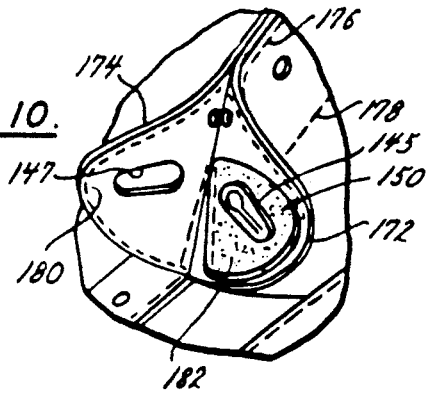
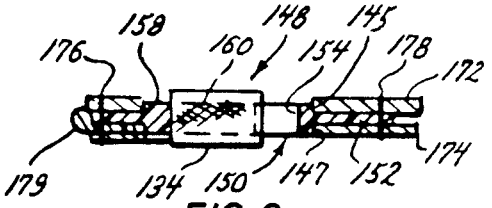
FIG. 9.
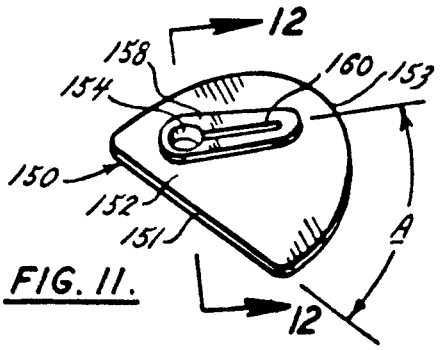
FIG. 11.
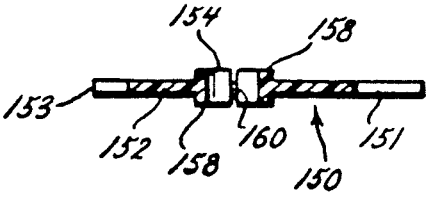
FIG. 12.

FOOTWEAR LACE LOCKING ASSEMBLY

RELATED U.S. APPLICATION DATA

This application is a continuation of Ser. No. 07/219,936, filed Jul. 15, 1988, now abandoned; which is a continuation-in-part of Ser. No. 07/074,953, filed Jul. 17, 1987, now U.S. Pat. No. 4,899,466; which is a continuation-in-part of Ser. No. 06/916,531, filed Oct. 8, 1986, now abandoned.

BACKGROUND OF THE INVENTION

This invention relates generally to improvements in the lacing assembly for an article of footwear, and more particularly to an improved lacing assembly for an article of footwear which provides lace-locking eyelets to permit the lace to be adjusted and maintained and also, with respect to footwear having upper and lower sections, the assembly provides a system of lace-locking eyelets in which lower and upper vamp sections can be selectively adjusted and maintained to fit different portions of the foot independently while utilizing a continuous single lace between said vamp sections.

Three prior patents of particular interest in this field are U.S. Pat. No. 3,546,796, U.S. Pat. No. 4,200,998 and U.S. Pat. No. 4,538,367. All three patents are commonly owned by the owner of this invention.

In the first patent an athletic shoe is disclosed having separate, or split, lower and upper vamp sections. In this shoe, each vamp section includes a separate lace and, while it is intended that each vamp section can be adjusted to suit separate portions of the foot, there are disadvantages in using separate laces for each vamp since this results in having four lace ends and two bows on each shoe. The second patent overcomes this problem to some extent by providing a single continuous lace which extends between split upper and lower vamp section and a central clamp which is disposed between the upper and lower vamp section for selectively adjusting the fit. This lacing arrangement overcomes aforementioned problem of having additional lace ends and bows but the single centralized clamp provided on each shoe is somewhat complicated and requires more manual dexterity to operate than is desirable in some cases. The third patent is the closest known prior art and disclosed a continuous lace extending between multiple split vamp sections. At the upper end of the lower vamp section opposed lace-receiving locking means are provided in the form of D-ring connectors. While this is an effective locking means it requires the use of special attachment locking means.

SUMMARY OF THE INVENTION

This lacing assembly for an article of footwear is particularly suitable for use with an athletic shoe and provides for adjusting and maintaining a lace in a desired position, and, in the case of an athletic shoe with upper and lower vamp sections for adjusting and maintaining the fit of the lower vamp section independently of the upper vamp section and utilizes a single continuous lace presenting a normal appearance and having the capability of being conventionally tied at the upper end.

One aspect of this lacing assembly provides a vamp section including opposed vamp portions having an upper end and a lower end and a plurality of lace-receiving eyelets, at least one pair of opposed eyelets including locking means said locking means including an individual plate portion providing an eyelet opening and an elongate, relatively narrow communicating slit, and a lace received by said locking eyelets in selectively lockable friction relation within the slit of said plate portion to permit the lace to be adjusted and maintained in adjustment.

Another aspect of this lacing assembly provides a first vamp section including opposed vamp portions and a second vamp section, disposed upwardly adjacent of the first vamp section and including opposed vamp portions; and first vamp portions having an upper end and a lower end and a plurality of lace-receiving eyelets including a pair of opposed eyelets disposed at said upper end; the second vamp portions having an upper end and a lower end and a plurality of lace-receiving eyelets including a pair of opposed eyelets disposed at said lower end, adjacent said first vamp portion upper end eyelets; at least one pair of adjacent end eyelets including locking means, and a single continuous lace having opposed side lengths, said side lengths being received by opposed lace-receiving eyelets in said first vamp portions, and said side lengths extending between said first and second vamp sections and being received by opposed lace-receiving eyelets in said second vamp portions, said lace being received by said lace-receiving locking eyelets in selectively lockable relation to permit the first vamp section to be adjusted and maintained in adjustment substantially independently of the second vamp section.

It is an aspect of this invention to provide that the locking means includes slits receiving said continuous lace in locking relation.

It is an another aspect of this invention to provide that the upper end eyelets of the first vamp portions and the lower end eyelets of the second vamp portions both include locking means.

It is yet another aspect of this invention to provide that the locking means of both pairs of adjacent eyelets include slits receiving said continuous lace in locking relation.

Another aspect of this invention is to provide that sad locking means include an eyelet opening and an apertured lock member disposed below said eyelet opening and attached to its associated vamp portion said lock member including overlap portions defining a slit receiving said continuous lace in locking relation.

It is still another aspect of this invention to provide that the locking means include an eyelet opening and a transversely disposed and inwardly extending slit communicating with said eyelet opening.

It is an aspect of this invention to provide that the locking means includes a plate portion having an opening and a communicating slit extending diagonally inwardly of said associated vamp portion.

Another aspect of this invention is to provide that each plate portion includes a substantially straight margin portion and an arcuate portion connecting the ends of said straight portion, said opening being disposed substantially closer to one end of said straight margin than the other end.

Still another aspect of this invention is to provide that the plate members at the upper end of the first vamp portion and the lower end of the second vamp portion are disposed in overlapping relation so that the lace portions connecting the first and second vamp sections are substantially perpendicular to the longitudinal axis of the lace assembly.

Yet another aspect of this invention is to provide that the slits of the first vamp plate portions extend upwardly and the second vamp plate portions extend downwardly and another aspect to provide that the angle of inclination is substantially in the range of about thirty to ninety degrees (30°-90°), and preferrably about fifty degrees (50°), to the straight margin portion.

Still another aspect of this invention is to provide that each plate portion includes a thickened, reinforcing, area disposed about said opening and said slit and another aspect to provide said thickening on the front and rear faces so that said faces are in mirror image of each other.

Another aspect of this invention is to provide that said first and second vamp portions are formed from at least two plies of material having said plate portions sandwiched therebetween and another aspect to provide that said plate portions are adhesively attached to at least one of said material plies and another aspect to provide that each ply includes an eyelet opening having a configuration corresponding substantially to said thickened oblong portion.

It is an aspect of this invention to provide opposed lace-locking eyelets at the upper end of the vamp section as a whole or at a desired point intermediate the upper and lower end of the vamp section as a whole to permit a lace to be adjusted to suit the wearer of the footwear.

BRIEF DESCRIPTION OF THE DRAWINGS

FIG. 7 is a fragmentary perspective view showing another modified construction with the upper vamp section unlaced;

FIG. 8 is a similar view showing the upper vamp section laced;

FIG. 9 is an enlarged cross-sectional view taken on line 9—9 of FIG. 8;

FIG. 10 is a fragmentary perspective view showing the attachment of the locking member of FIG. 7;

FIG. 11 is an enlarged perspective view of said locking member;

FIG. 12 is a cross sectional view taken on line 12—12 of FIG. 11;

DESCRIPTION OF THE PREFERRED EMBODIMENT

Figure 1:
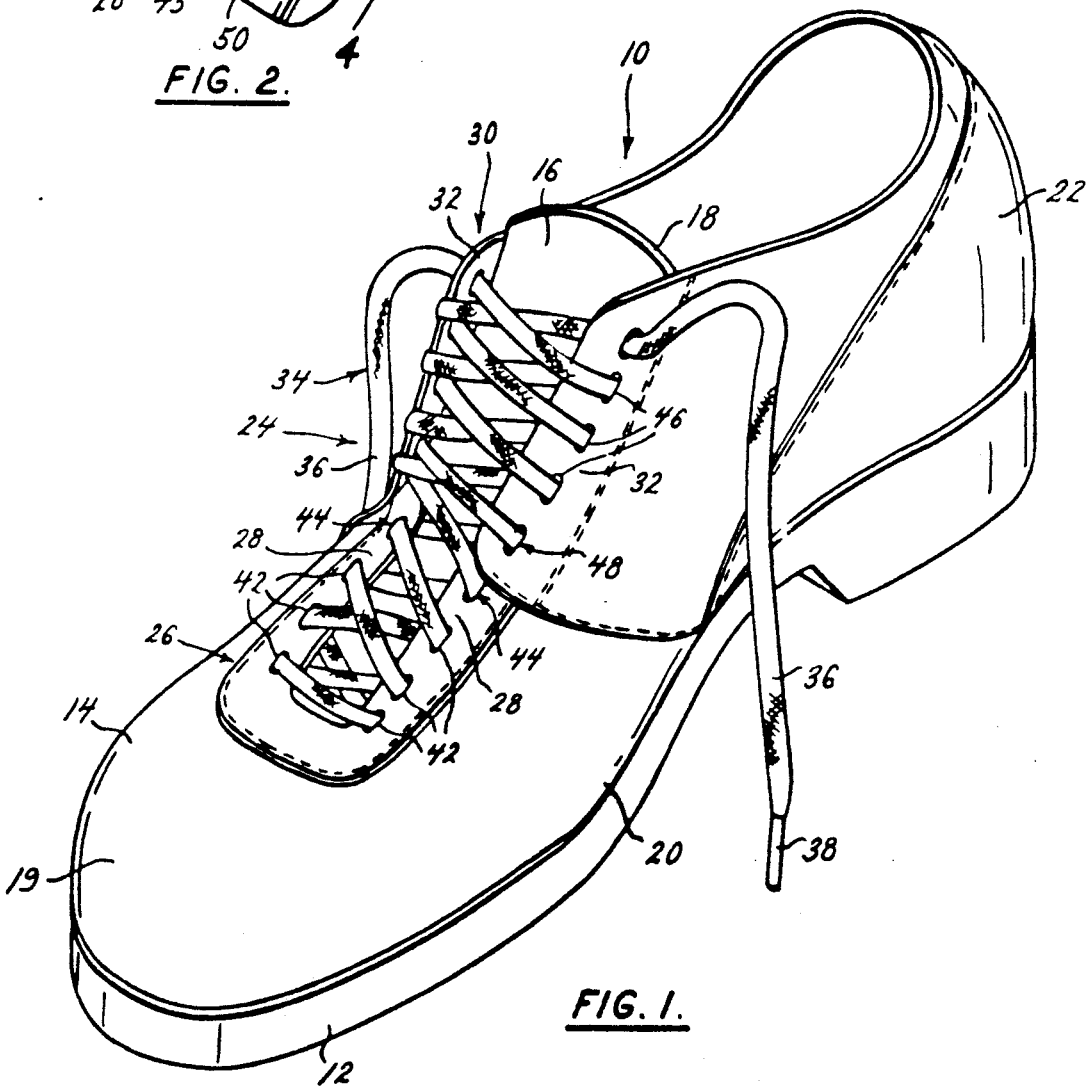
FIG. 1 is a perspective view of an athletic shoe having the lacing assembly.

Referring now by reference numbers to the drawings and first to FIG. 1 it will be understood that the athletic shoe 10 includes a sole 12, uppers 14 attached to the sole 12 and a tongue 16, attached to said uppers 14 as by stitching, and having a free upper end 18. The uppers 14 also include a toe portion 19, opposed side portions 20 attached to the sole and including side quarters 22. As shown, the shoe also includes a vamp generally indicated by numeral 24.

In the embodiment shown, the vamp 24 includes a first vamp section 26 disposed adjacent to the toe portion 19 and having oppositely disposed vamp panel portions 28 and a second vamp section 30 disposed upwardly adjacent of the first vamp section 26 and having oppositely disposed vamp panel portions 32. As clearly shown in FIG. 1, the first and second vamp sections 26 and 30 are disposed in separated overlapping relation from each other providing flexibility of the vamp in facilitating independent movement of the vamp sections.

Referring now more specifically to the lacing connection of the shoe 10, it will be understood that said shoe is provided with a single continuous lace 34 having opposed side lengths 36 terminating in reinforced ends 38. The lace 34 cooperates with the vamp sections to provide a lacing assembly, in which the lace interconnects the first and second vamp sections 26 and 30, respectively, and provides for adjusting the fit of the said vamp portions for the comfort of the wearer. More particularly, the first vamp portions 28 are provided with a plurality of opposed eyelets 42, constituting lace-receiving means, and opposed locking eyelets 44, constituting lace-receiving locking means. The second vamp portions 32, which are separated from the first vamp portions 28 by the split include a plurality of eyelets 46 constituting lace-receiving means and opposed locking eyelets 48 constituting lace-receiving locking means. As shown locking eyelets 48 are disposed in longitudinally spaced adjacent relation to said locking eyelets 44.

In one preferred embodiment, and as clearly shown in FIGS. 2-5, each of the opposed locking eyelets 44 includes an apertured plastic lock member 50 which is attached to the underside of the opposed vamp portions 28 and 32 as by stitching. The lock member 50 which, in the preferred embodiment is molded, includes an upper face 52 having an opening 54 conforming at least in part to the eyelet opening 45 which can be the same size or larger than the openings 42 and 46. The opening 54 includes an inwardly formed portion 56 and the lock member 50 includes an integrally formed portion 58 disposed in overlap relation to said portion 56 and spaced from said portion to provide a gap or split indicated by numeral 60. It will be understood that opposed lock members 50 on opposed vamp portions are molded in mirror image of each other.

Figure 6:
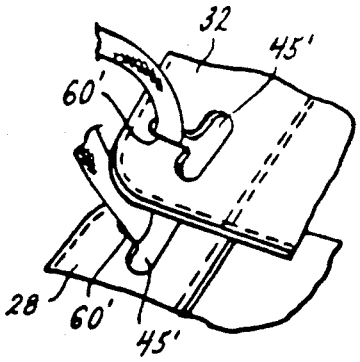
FIG. 6 is an enlarged fragmentary view showing details of the locking eyelets of a modified construction.

A second embodiment is clearly shown in FIG. 6. In this modification the locking action is provided by an inwardly formed slit 60' which is in the nature of a cut and receives the lace in friction relation. The opposed slits 60', both being inwardly formed are disposed in mirror image of each other.

Another embodiment is clearly shown in FIGS. 7-13 which incorporates some of the features of the two embodiments discussed above. For convenience, and where appropriate, similar parts have been given similar reference numerals with the addition of a prefix numeral 1 in describing this modification.

As with the embodiments already described the vamp 124 includes a first, lower, vamp section 126 having oppositely disposed vamp panel portions 128 and a second, upper, vamp section having oppositely vamp panel portions 132. The single continuous lace 134, having side lengths 136, cooperates with the vamp sections 126 and 130 and interconnects said sections to provide a comfortable fit for the wearer. More particularly the first vamp portions 128 are provided with a plurality of opposed eyelets 142, constituting lace-receiving means and, at the upper end, opposed locking eyelets 144, constituting lace-receiving locking means. The second vamp portions 132, which are separated from and overlap the first vamp portions 128, include a plurality of eyelets 146, constituting lace receiving means and, at the lower end, opposed locking eyelets 148. Locking eyelets 144 and 148 include locking members 150 attached to the vamps at the corners as shown in FIG. 10.

As shown in FIG. 11 each locking member 150 is molded or otherwise formed to include a flexible plate portion 152 having a straight margin 151 and an arcuate margin 153. The plate portion is apertured to provide a circular opening 154 disposed closer to one end of margin 151 than the other, which is generally the same diameter as the other eyelets 142 and 146, and a communicating slit 160. The circular opening 154 and slit 160 are reinforced by a generally oblong-shaped thickened portion 158, disposed about said opening and said slit and tapering somewhat toward the end of the slit. This additional thickness also provides an anti-fray feature by increasing the friction area available to grip the lace 134. The slit 160 in the embodiment shown extends diagonally across the plate portion 152 on a line which passes from one corner, at an angle A to the straight margin 151 in the range of about thirty to ninety degrees (30°-90°) the selected angle in the embodiment shown being about fifty degrees (50°). In the embodiment shown the plate portion 152 is generally parabolic in configuration having a straight margin of 23.5 mm and a height of 19.0 mm. The opening is 4.0 mm and is offset from the base about 6.0 mm and from the axis about 5.0 mm. The slit is about 8.0 mm long, the thickness of the plate portion is 1.0 mm and the total thickness of the thickened area about 3.5 mm. This size of locking member has been found to have substantially universal applicability from children's to adult's shoe sizes.

The configuration of the locking member 150 facilitates attachment between the plies of the material forming the vamp portions which are rounded at the corners. For example, as shown in FIG. 10, the upper vamp corner 170 is formed essentially of upper and lower plies 172 and 174, attached as by generally parallel lines of stitching 176 and 178 connected by an arcuate portion 180. In addition, if desired, edge piping 179 may be provided between the two plies. The stitching generally encloses the locking member 150 but the plate portion 152 is sufficiently thin, of the order of 1.0 mm in the embodiment shown, that it can, if desired, be connected at least in part by stitching as, for example, adjacent the locking member straight margin 151 or by catching the front corner. Preferably, the locking member 150 is formed from thermoplastic or thermosetting resin such as nylon or urethane, or other suitable plastic, having flexible yet readily penetrable characteristics. In addition, the locking member 150 is, in the embodiment shown, adhesively attached to the plies of material 172 and 174 by applying a thin coating of adhesive 182 such as latex between each ply and a corresponding face of the locking member 150 said adhesive acting as a pre-stitching locating means.

It will be observed, by reference to FIGS. 8-10, that each ply of material 172, 174 is apertured to provide an oblong-shaped opening 145, 147 corresponding substantially to the shape of the reinforcing oblong portion 158 so that said thickened portion extends, at least in part, within said openings 145, 147.

Figure 13:
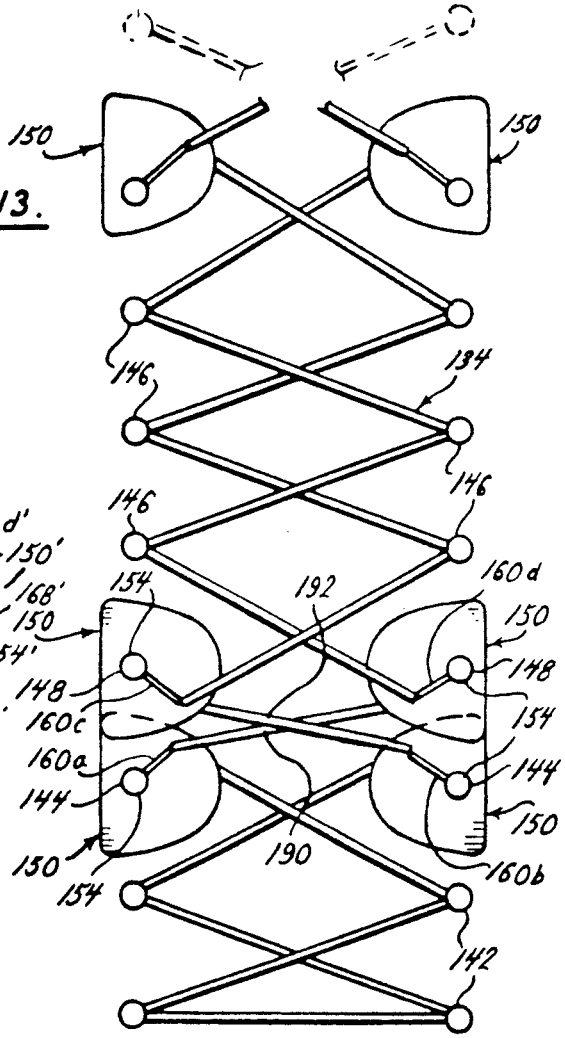
FIG. 13 is a schematic view of the lacing arrangement of the modified construction of FIG. 7.

As will readily be understood by reference to FIGS. 12 and 13 the provision of an oblong portion 158 on both faces of the locking member 150 provides that when said locking member is turned over the configuration of the rear face is substantially in mirror image of the configuration of the front face. The result of this is that it is a simple matter to arrange the locking members 150 such that the diagonal slits **160*c* and 160*d* of the upper locking members 150 are inclined downwardly and inwardly relative to the opening 154 while the diagonal slits 160*a* and 160*b* of the lower locking members 150 are inclined upwardly and inwardly. The result of this arrangement, as shown in FIG. 13, is that the angles of inclination of the lace portion 190 between the slits 160*a* and 160*d* respectively, of the lower vamp left locking member and the upper vamp right locking member, and the angle of inclination of the lace portion 192 between the slits 160*b* and 160*c*** respectively of the lower vamp right locking member and the upper vamp left locking member and are relatively flat, which tends to increase effectiveness of the the locking action.

Figure 14:
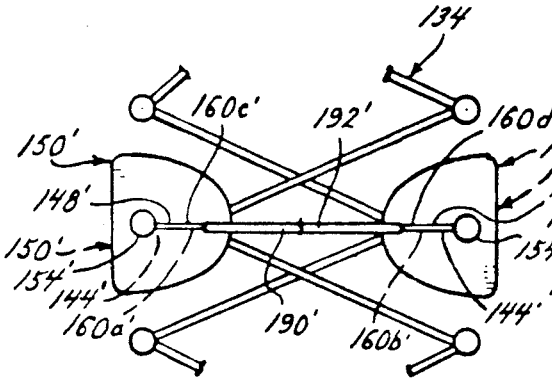
FIG. 14 is another schematic view of said lacing arrangement.

It will be understood from FIG. 13 that the relationship between the ends of the slits is a function of the offset of the opening 154, the angle of inclination of the slit 160 and also the overlap of the plate portions at the upper end of the first vamp portions and the lower end of the second vamp portions. With the characteristics of the locking member 150 described above the placing of the locking members in register, as opposed to being longitudinally spaced as shown in FIG. 13, the angle of inclination of the lace portions would be substantially zero degrees and said lace portions would substantially perpendicular to the longitudinal axis of the lacing assembly. As will be understood this perpendicularity can be achieved by other locking member arrangements. For example, as shown in FIG. 14, in which similar parts use the same numeral with a prime suffix, with the opening 154 disposed on the axis of the plate member and the angle A (FIG. 11) made ninety degrees (90°) the slits **160*a*', 160*c*' and 160*b*', 160*d*' would be aligned and lace portions 190' and 192' would be perpendicular. It will also be understood that the theoretical considerations discussed above are affected by the width of the lace and that the arrangement of the locking member 150 shown in FIG. 11 has produced good results with the overlapping locking members substantially in register. As will also be understood the other characteristics of the lace such as texture, material, and elasticity also affect the locking capability of the slit 160**. In general, the width of the slit is less than the thickness of the lace so that said lace is received in friction relation within said slit.

Figure 15:
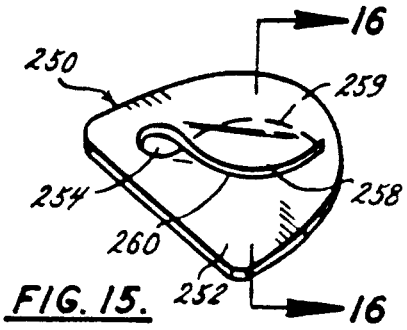
FIG. 15 is a similar view to FIG. 10 showing another modified construction.
Figure 16:
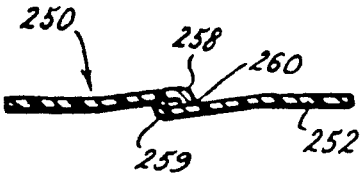
FIG. 16 is a cross sectional view taken on line 16—16 of FIG. 15.

Another embodiment of the locking member is shown in FIGS. 15 and 16 by numeral 250. This embodiment is similar to locking member 150 except that, in lieu of a reinforced opening and slit, an opening 254 is provided in the plate portion 252 in conjunction with a communicating slit 260 which is formed from overlapping flexible plate portions 258 and 259 hooked at the ends. This arrangement provides a clamping effect by virtue of the flexible nature of the plate portions which must be sprung apart to receive the lace. In other aspects this locking member 250 is similar to locking member 150.

Figure 2:
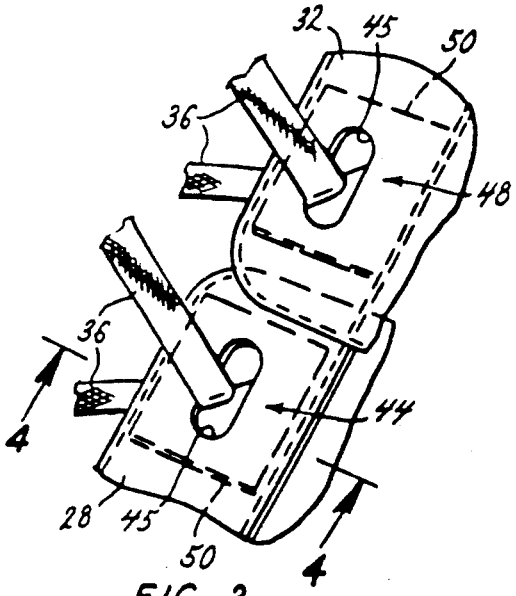
FIG. 2 is an enlarged fragmentary view showing the details of the locking eyelets.
Figure 3:
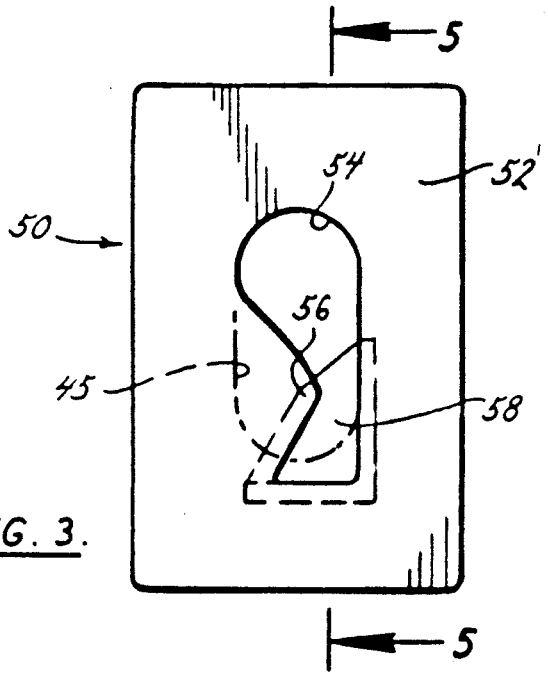
FIG. 3 is an enlarged plan view of the locking plate.
Figure 5:
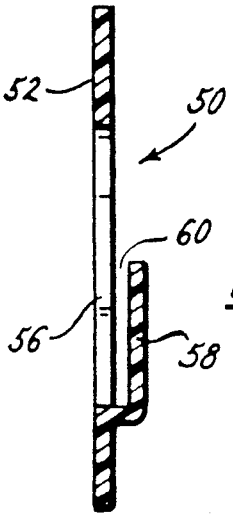
FIG. 5 is a sectional view taken on line 5—5 of FIG. 4.
Figure 4:
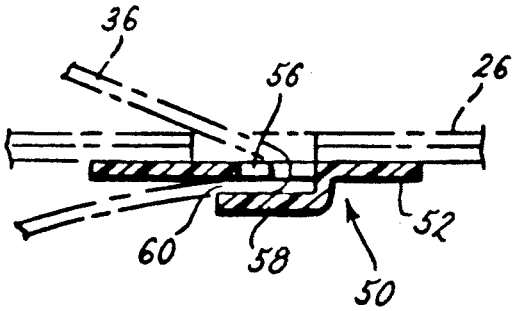
FIG. 4 is a sectional view taken on line 4—4 of FIG. 2.

It is thought that the structural features and functional advantages of this lacing assembly have become fully apparent from the foregoing description of parts, but for completeness of disclosure the adjustment of the fit of the vamp sections and the locking of the lacing assembly will be briefly described and first with respect to the embodiment shown in FIGS. 2–4.

Initially the lace 34 is loosely threaded into place within the lower eyelets 42 and locking eyelets 44 of the first vamp portions 28, and the locking eyelets 48 and the upper eyelets of the second vamp portions 32. The foot of the wearer can then be easily inserted into the shoe 10. When this has been accomplished, the fit of the first vamp section can be adjusted by pulling the slack out of the lace side lengths 36 below the locking eyelets 44 of the first vamp and pulling the lace lengths from the locking eyelets 54 into position between the slit defined by overlapping portions 56 and 58 as shown in FIGS. 3 and 4. The lace lengths 36 in the first vamp section are adjusted by pulling on the upward portion of these lace lengths which because of the overlapping portions 56 and 58 effectively locks the lace in place. The lace portions 36 tend to bind in the slit 60 thereby being inhibited from moving by the fictional effect of the pressure from the overlapping elements 56 and 58 which are spaced closer together than the thickness of the lace. Following this adjustment, the forward foot portion and the toes of the wearer are comfortably gripped by the lower first vamp section to the desired fit of the wearer. The remainder of the lace lengths above the locking eyelet 48 of the upper vamp section can then be adjusted while maintaining the fit of the first vamp section and, because of the provision of said second locking eyelets, the lace can also be adjusted between two pairs of adjacent locking eyelets 48. The second vamp sections can then be adjusted substantially independently of the first vamp section to comfortably grip the portion of the foot to which they are adjacent. The adjustment of the upper vamp sections is accomplished independently of, and without disturbing the fit of, the lower vamp section because of the locking action of both sets of locking eyelets 44 and 48. When this is accomplished the free ends of the lacing at the top of the shoe 10 can then be tied or otherwise secured in a conventional fashion.

The lacing of the embodiment shown in FIG. 6 is accomplished in a similar manner to that described above. The lacing of the embodiment shown in FIGS. 7–13 is also similar but the particular arrangement of the locking members 150 presents certain advantages which will be described with reference to FIGS. 7, 8 and 13.

Initially, the first vamp section 128 is laced by threading the lace 134 through eyelets 142 and the locking member opening 154 of locking eyelets 144, inserting the foot and adjusting the fit for comfort. When this has been accomplished the lace side lengths 136 are, as shown in FIG. 7, pulled upwardly into the associated locking member slits of the locking eyelets 144. When this has been accomplished the side lengths are crossed over and inserted into the locking member openings 154 of locking eyelets 148 and loosely threaded through eyelets 146. When this has been accomplished the lace side lengths can be adjusted for fit between the vamp sections, and said side lengths pulled downwardly into the associated locking member slits of locking eyelets 148. Following this the slack in the lace in the second vamp section can be taken up and the lace tied in a bow conventionally or locked by using locking members 150 as shown in FIG. 13. Because of the inwardly directed and inclined arrangement of the lace assembly, as best shown schematically in FIG. 13, the lace connection between the connected upper and lower vamp locking member slits 160*a*, 160*d* and 160*b*, 160*c* is inclined at a substantially flatter angle than is the case with the inclination of the lace which passes through the eyelets, above and below the locking eyelets. The result of this arrangement is that the lace tends to be locked more securely in place.

It will be understood that although the preferred embodiment is shown as an athletic shoe, the lacing assembly can be sued for other articles of footwear having tow or more vamp sections. In addition, the locking member described can be used at any eyelet where locking the lace is desirable.

For example, it is sometimes desired to have a pair of locking eyelets 150 at the upper end of the vamp as a whole as shown in FIG. 13 which permits the lace end sot hang out and be maintained in adjustment as desired by the wearer. In the case of high top athletic shoes (not shown), it might be desirable to provide locking eyelets below the upper end of the vamp as a whole, (shown doted in FIG. 13).

Figure 17:
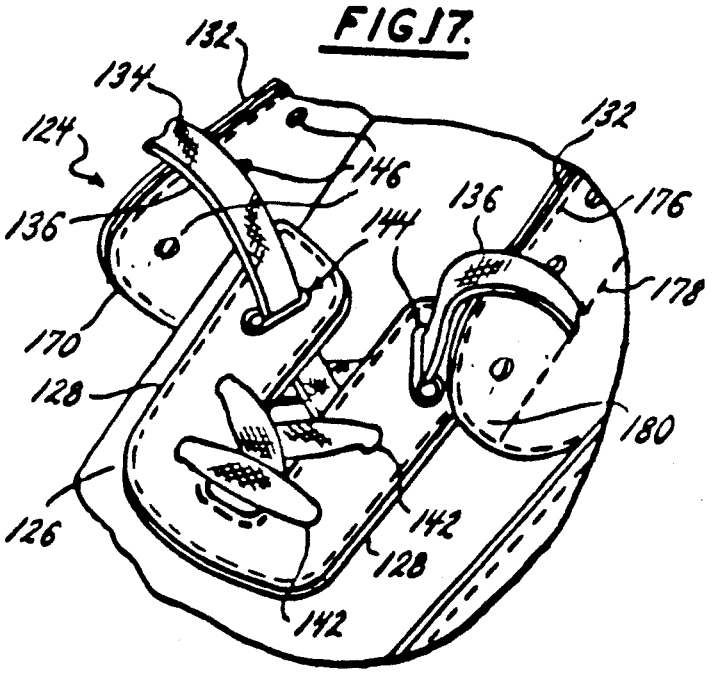
FIG. 17 is a similar view to FIG. 7 showing a modified construction.

Further, and as shown in FIG. 17, the assembly can be used with only one pair of lace locks, for example in the lower vamps only. In this case the upper vamp lace locks are substituted by conventional eyelets 146.

In view of the above it will be seen that various aspects and features of the invention are achieved and other advantageous results attained. While a preferred embodiment of the invention has been shown and described, it will be clear to those skilled in the art that changes and modifications may be made therein without departing from the invention in its broader aspects.

I claim as my invention:

1. A lacing assembly on an article of footwear comprising:

(a) a vamp section including opposed vamp portions having an upper end and a lower end and a plurality of lace-receiving eyelets, said vamp portions being formed from at least tow plies of material defining an inner vamp margin, (b) at least one pair of opposed eyelets including locking means, said locking means including an individual plate portion providing a single eyelet opening and an elongate, relatively narrow communicating slit integrally formed in said individual plate portion, said plate portion being disposed in sandwich relation between said plies with said opening and slit disposed in spaced relation from the vamp margin and having vamp material on each side thereof, and (c) a lace received by said locking eyelets in selectively lockable friction relation within the slit of said plate portion said slit providing the sole locking means of each plate portion to permit the lace to be adjusted and maintained in adjustment.

2. A lacing assembly as defined in claim 1, in which:

(d) each plate portion includes inner thickened portions adjacent each side of the slit providing reinforcement for each side of said slit and relatively thin outer portions on each side of said thickened portions and said vamp material substantially covers said thin outer portions.

3. In a lacing assembly on an article of footwear, said lacing assembly having opposed vamp portions, each vamp portion being formed from at least tow plies of material, and each vamp portion including a plurality of lace-receiving eyelets, a lace having a lace thickness, and at least one of said eyelets including an improved locking means, the improvement comprising:

(a) an individual substantially planar plate portion including an eyelet opening and an elongate, relatively narrow communicating slit integrally formed in said individual plate portion and having substantially parallel sides and being of a length substantially greater than the diameter of the opening and narrower than the thickness of the lace to grip said lace in friction relation, the plate portion including upper and lower reinforcing thickened portions adjacent each side of the slit, and at least partly defining said slit, said slit sides being substantially perpendicular to said plate portion said plate portion including a relatively thin outer portion on each side of said thickened portions, at least the upper thickened portion being uncovered by said vamp material.

4. In a lacing assembly for an article of footwear of the type having opposed vamp portions, each vamp portion being formed from at least two plies of material, and each vamp portion including a plurality of lace-receiving eyelets, at least one of said eyelets including an improved locking means, the improvement comprising:

(a) an individual, substantially planar plate portion including a relatively thin outer portion and a relatively thick substantially oblong reinforced inner portion disposed above and below said outer portion, said inner portion including an eyelet opening and an elongate relatively narrow communicating slit integrally formed in said individual plate portion, said slit having substantially parallel sides and being of a length substantially greater than the diameter of the opening and having a thickness less then the thickness of the lace and said slit sides being substantially perpendicular to said outer plate portion, said outer plate portion being disposed all around said oblong portion and at least in part defined by an arcuate margin at the end of said slit opposite to said opening, said outer plate portion being disposed in sandwich relation between said plies of vamp material and attached to at least one of said plies and at least the inner plate portion disposed above said outer plate portion being uncovered by said upper ply of said vamp material the outer plate portion being substantially covered by said upper ply of said vamp material.

* * * * *